United States Patent [19]

Smith

[11] 4,336,891

[45] Jun. 29, 1982

[54] ADAPTER CLOSURE

[75] Inventor: Jack D. Smith, Billings, Mont.

[73] Assignee: Smithy, Inc., Billings, Mont.

[21] Appl. No.: 157,262

[22] Filed: Jun. 9, 1980

[51] Int. Cl.[3] ..... B65D 45/30; B65D 45/32; B65D 45/34

[52] U.S. Cl. ..... 215/276; 215/100 R; 215/356; 141/98; 141/319; 141/364

[58] Field of Search ..... 215/276, 356, 100 R; 141/98, 332, 319, 310, 383, 364; 259/54

[56] References Cited

U.S. PATENT DOCUMENTS 2,028,489 1/1936 Baker ..... 215/356 X
3,028,032 4/1962 Jones ..... 215/100 R
3,156,272 11/1964 Indrunas ..... 215/100 R X
3,620,267 11/1971 Seablom ..... 141/364

*Primary Examiner*—George T. Hall
*Attorney, Agent, or Firm*—Arthur L. Urban

[57] ABSTRACT

An adapter closure for a container including a body portion, an axial passage extending through the body portion, an inwardly extending shoulder portion disposed along the length of the body portion intermediate the ends thereof, a first internally threaded section extending from one end of the body portion toward and terminating closely adjacent to the shoulder portion, and a second internally threaded section extending from the opposite end of the body portion toward and terminating closely adjacent to the shoulder portion.

5 Claims, 4 Drawing Figures

ADAPTER CLOSURE

This invention relates to a novel adapter device and more particularly relates to a new adapter closure.

Through the years, food and other materials have been packaged in a variety of containers. Cans, boxes, bottles, bags and the like have been utilized as containers. For moist materials, cans and bottles often are used. In applications where the contents are used a small amount at a time, bottles and jars are preferred because such containers can be fitted with closures which can be removed and replaced conveniently. Thus, the closure can be removed, a small quantity of food or another substance taken from the jar or bottle, the cap replaced and the container stored until the next time more is needed. The procedure is repeated each time until the contents are gone.

Generally, when most of the contents of a container has been used and only a small amount of the food remains in the container, it becomes increasingly difficult to remove the remainder. In the past when food was less expensive, many people simply used as much food as could be easily removed from the container. This might be simply spooning the contents from a jar until the spoon did not carry much with each dip thereof and then discarding the jar.

With substances which were poured from a bottle, the amount remaining at the time the bottle was discarded depended to a large degree upon the ease with which the contents could be poured from the bottles. If the contents had a high viscosity such as catsup, a considerable amount probably would be discarded since it takes considerable time and effort to get the last part of the catsup from the bottle.

As the cost of food and other materials increased significantly in recent years, more people have been making a concerted effort to use a greater proportion of the contents before discarding the container. If the opening of the jar or bottle is sufficiently large, a scraper, knife, spoon or other kitchen tool can be inserted into the container and some of the ordinarily discarded contents removed. However, if the opening of the container is small such as a catsup bottle, it is not possible to manipulate any tool even if it is long and narrow enough to be inserted through the opening.

If inserting a kitchen tool into a container is not successful or if a person is not willing to take the time required to use a tool, some individuals simply invert the container over another container and allow the contents remaining in the old container to flow by gravity into the new container. Since placing one container on top of another generally is not a stable arrangement, it is customary to place the two containers in a corner where they would be less likely to be disturbed.

Even when such precautions are taken, often the upper container will shift its position and fall away. This produces a mess since the contents of the upper container usually flow from the upper container onto the counter instead of into the lower container. The instability of the stacked containers is accentuated with tall, narrow bottles with relatively small openings such as catsup bottles.

Thus, a person is left to discover a means for accomplishing the removal of the last part of the contents of a bottle or jar. While some ingenious individuals may have solved this problem in one way or another, most persons still struggle to remove the last portion of the contents of a container by some method which is not satisfactory to them.

The present invention provides a novel adapter closure for containers to facilitate removal of the last portion of the contents. The adapter closure of the invention enables the contents to be removed simply and easily. The adapter simplifies the transfer of the contents from one container to another. The probability of one container slipping from its position allowing the contents to spill onto a work surface is greatly reduced.

The adapter closure of the invention can be used conveniently with a minimum of instruction, even by children. The adapter closure is suitable for use as a normal closure for the life of the container or can be used only when contents are being transferred as described above.

The adapter closure of the invention is simple in design and relatively inexpensive to manufacture. The adapter closure can be fabricated from commercially available materials using conventional closure forming techniques.

Other benefits and advantages of the novel adapter closure of the present invention will be apparent from the following description and the accompanying drawings in which.

Figure 1:
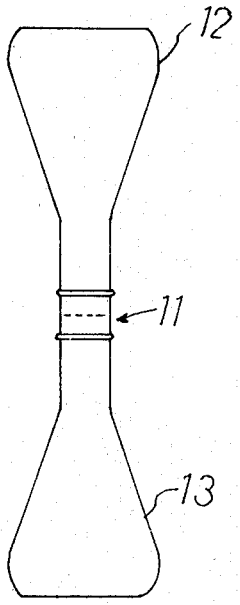
FIG. 1 is a side elevation of one form of the novel adapter closure of the invention in use with two bottles.

As shown in the drawings, one form of the adapter closure 11 of the invention is in use with two bottles. An upper bottle 12 is maintained in an inverted position and joined with a lower bottle 13. The two bottles 12 and 13 being affixed to the common adapter closure 11 form a single assembly therewith.

Figure 2:
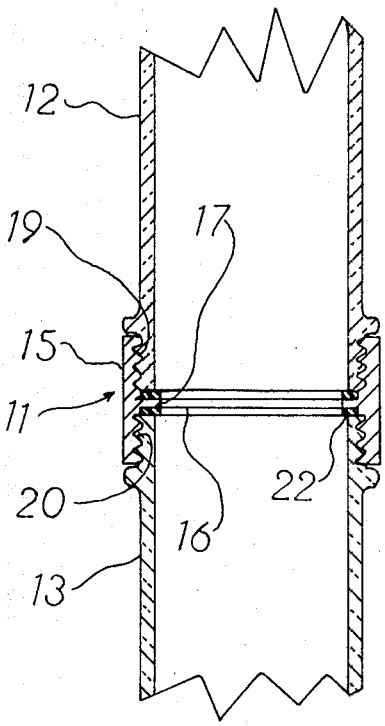
FIG. 2 is an enlarged fragmentary view of the adapter closure of the invention shown in FIG. 1.

Adapter closure 11 shown in greater detail in FIG. 2 includes a body portion 15 with an axial passage 16 extending therethrough. A shoulder portion 17 extends inwardly from the body portion 15. The shoulder portion 17 is disposed along the length of the body portion 15, preferably at substantially the midpoint thereof. Advantageously, the shoulder portion includes sealing means shown as gaskets 22. Preferably, the sealing means is disposed on the sides of the shoulder portion adjacent to the first and second threaded sections.

The adapter closure 11 also includes a first threaded section 19 extending from one end of the body portion 15. The threaded section 19 is internally threaded and terminates closely adjacent to the shoulder portion 17. Likewise, the adapter closure 11 includes a second internally threaded section 20 which extends from the opposite end of the body portion 15. The second threaded section also terminates closely adjacent to the shoulder portion 17. Preferably, the first and second threaded sections are substantially the same diameter and length. Although the adapter closure may be formed by combining two conventional closures and providing a central opening therethrough, it is desirable that the adapter be formed as a unitary structure as shown.

Figure 3:
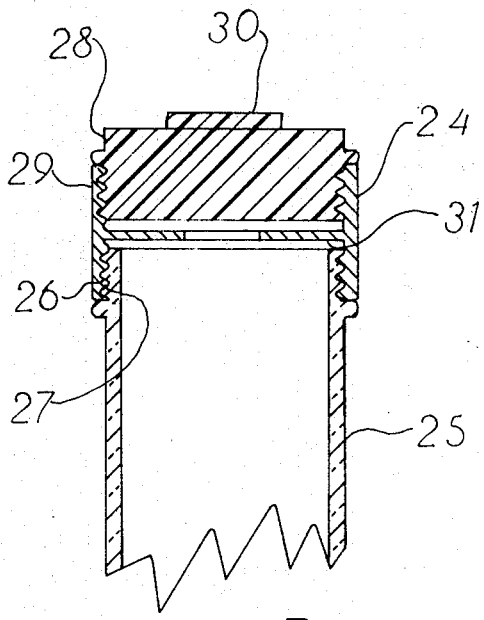
FIG. 3 is an enlarged fragmentary view of a different form of the adapter closure of the invention in use as a normal closure.
Figure 4:
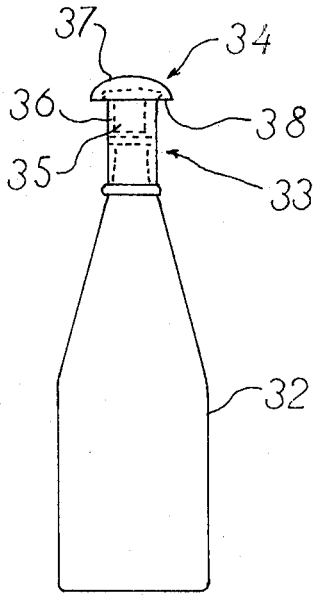
FIG. 4 is a side elevation of another form of the adapter closure in use as a normal closure.

FIGS. 3 and 4 illustrate the utilization of the adapter closure of the invention as a normal closure during the life of the container. As shown in FIG. 3, an adapter closure 24 is affixed to a bottle 25 by threading section 26 of the closure onto the threaded portion 27 of the bottle. The adapter closure 24 includes a cover shown as plug member 28 capable of sealing the exposed opening of the adapter. The plug member 28 mates with threaded section 29 of the adapter. A strip 30 extends upwardly from the top surface of plug member 28 to facilitate removal thereof from the adapter. The shoulder portion of adapter closure 24 may include a section 31 with a central opening, the section being disposed transversely of the body portion 15 as shown.

In FIG. 4, a bottle 32 has an adapter closure 33. A cap member 34 has an internal portion 35 which extends downwardly into the axial passage 36 through the adapter. The cap member 34 includes an external dome portion 37 which surrounds the exposed upper lip 38 of the adapter 33 and covers it.

The novel adapter closure 11 of the present invention is used when it becomes difficult to remove the contents of a bottle 12 such as when only a small quantity remains. At that time, one of the threaded sections 19 of the adapter is threaded onto the threaded neck of bottle 12. Then, the other threaded section 20 is threaded onto the threaded neck of a second bottle 13 which is to act as the receiver of the remaining contents of bottle 12.

The assembly is placed in the position shown in FIG. 1 with bottle 12 inverted. The base of bottle 13 is then positioned on a work surface and the assembly set aside for a period of time. The bottles are checked from time to time and when all of the contents of bottle 12 have flowed by gravity into bottle 13, bottle 12 can be removed and discarded. Adapter 11 next may be removed, washed and stored for use at a later time. The original closure can be replaced on bottle 13. When the contents of bottle 13 are almost gone, the procedure can be repeated by assembling the bottle with adapter 11 and another bottle (not shown).

FIGS. 3 and 4 illustrate ways in which the adapter of the invention can be utilized as the normal closure during the life of the bottle. A plug member 28 is threaded into adapter 24 to seal the exposed opening of the adapter. Thus, the combination of adapter 24 and plug 28 can be used as the normal closure with threaded section 26 of the adapter being unthreaded from threaded neck 27 of the bottle 25 each time access to the contents of the bottle is desired. After use, the combination is rethreaded onto the bottle for storage.

With bottle 32 as shown in FIG. 4, adapter 33 remains in place on the bottle 32 and only cap member 34 is removed each time some of the contents of the bottle are used. At that time, cap member 34 simply is removed with the internal portion 35 of the cap member being withdrawn from the opening 36 of the adapter 33. This exposes a passage 35 into the bottle 32 so that a portion of the contents can be removed. Thereafter, the cap member 34 is replaced with the internal portion 35 thereof being reinserted into the axial passage 35 to seal the passage for storage of the bottle.

The above description and the accompanying drawings show that the present invention provides a novel adapter closure for containers such as jars, bottles and the like. The adapter closure of the invention facilitates transfer of contents from one container to another simply and conveniently. The adapter enables an individual to salvage the last portions of the contents of a container easily. The adapter helps to minimize the problems of spilling during the transfer.

The adapter closure of the invention can be used conveniently with little if any instruction and even by children. The adapter closure also can be used as a conventional closure for the life of the container.

The adapter of the invention is simple in design and can be manufactured relatively inexpensively. Thus, the adapter lends itself to being furnished with the original package either as a replacement for the conventional closure or as an accessory or giveaway. Fabrication of the adapter can be accomplished using commercially available materials and manufacturing techniques.

It will be apparent that various modifications can be made in the particular adapter closure described in detail above and shown in the drawings within the scope of the invention. For example, the size and configuration of specific parts of the adapter can be changed to meet special requirements. While the adapter ordinarily is made of conventional closure materials such as metal or plastic, other materials may be employed provided they do not deleteriously affect the operation and functioning of the adapter. Therefore, the scope of the invention is to be limited only by the following claims.

What is claimed is:

1. An adapter closure for a container including a unitary body portion with a substantially uniform outside diameter, an axial passage extending through said body portion, an inwardly extending shoulder portion disposed along the length of said body portion intermediate the ends thereof, a first internally threaded section extending from one end of said body portion toward and terminating closely adjacent to said shoulder portion, a second internally threaded section extending from the opposite end of said body portion toward and terminating closely adjacent to said shoulder portion, said first and second internally threaded sections being of substantially the same diameter and length, the end of said body portion adjacent said second internally threaded section including an exposed lip surface, a plug member engageable with said second internally threaded section and sealing one end of said body portion, said plug member including an externally threaded section engageable with said second internally threaded section, said plug member also including a cover section, said cover section including a sealing surface engageable with said lip surface of said body portion, said cover section including a peripheral portion having a diameter substantially the same as that of said body portion; whereby said first internally threaded section normally is selectively removable from an externally threaded section of a container while said plug member is engaged with said second internally threaded section and said plug member being removed from said second internally threaded section and said second section threaded onto an externally threaded section of a second container similar to said first container to transfer contents of said first container to said second container.

2. An adapter closure according to claim 1 wherein said shoulder portion includes sealing means on the sides thereof adjacent to said first and second threaded sections.

3. An adapter closure according to claim 1 wherein said shoulder portion includes a section with a central opening disposed transversely of said body portion.

4. An adapter closure according to claim 1 wherein said adapter closure is a molded plastic structure.

5. An adapter closure according to claim 1 wherein said adapter closure is a deformed metal structure.

* * * * *